US005084928A

United States Patent [19]

Skillington

[11] Patent Number: 5,084,928

[45] Date of Patent: Feb. 4, 1992

[54] PILLOWCASE FORMED OF ELASTIC FABRIC

[76] Inventor: Adrienne M. Skillington, 150 Borica Way, San Francisco, Calif. 94127

[21] Appl. No.: 610,436

[22] Filed: Nov. 7, 1990

[51] Int. Cl.[5] ..... A47G 9/02

[52] U.S. Cl. ..... 5/490; 5/482; 5/485

[58] Field of Search ..... 5/490, 485, 486, 434, 5/436, 437, 441, 482

[56] References Cited

U.S. PATENT DOCUMENTS

| | | | |
|---|---|---|---|
| 1,542,561 | 6/1925 | Laskin | 5/490 |
| 1,716,145 | 6/1929 | Moudry | 5/490 |
| 3,312,987 | 4/1967 | Emery . | |
| 3,411,164 | 11/1968 | Sumergrade | 5/434 |
| 3,507,727 | 1/1970 | Marshack | 5/490 |
| 3,789,441 | 2/1974 | Weiss . | |
| 4,508,044 | 4/1985 | Downey | 5/490 |
| 4,651,371 | 3/1987 | Hahn | 5/490 |
| 4,864,669 | 9/1989 | Jones | 5/490 |
| 4,908,893 | 3/1990 | Smit | 5/434 |

FOREIGN PATENT DOCUMENTS 1432654 4/1976 United Kingdom ..... 5/490

*Primary Examiner*—Renee S. Luebke
*Assistant Examiner*—F. Saether
*Attorney, Agent, or Firm*—Flehr, Hohbach, Test, Albritton & Herbert

[57] ABSTRACT

A wrinkle free pillowcase for use in conjunction with a pillow of specific length and width measurements. The pillowcase includes at least a first and second section of fabric joined along three sides, each section of fabric having a length and width measurements less than that of the pillow. Releasable fasteners are provided along a fourth side of the pillowcase so that the pillowcase is fastenable about the pillow. The fabric is smooth and radially elastic so that when the pillow is placed within the pillowcase and the fasteners fastened, the compressive strength of the pillow causes the radially elastic fabric to stretch across the surface of the pillow creating a surface tension in said fabric which removes creases from the fabric, thereby creating a crease free surface in the pillowcase.

11 Claims, 4 Drawing Sheets

PILLOWCASE FORMED OF ELASTIC FABRIC

TECHNICAL FIELD

The present invention relates, in general, to pillow cases for bed pillows and the like produced in bedding industry sizes such as standard, queen and king. More specifically, the invention relates to wrinkle free pillow cases for use with these pillows.

BACKGROUND ART

It is well known that when human skin rests against an uneven surface, the pattern of that uneven surface is impressed into the human skin. This is quite noticeable, for example, when a person sits on grass. It is only a matter of time until blood circulation returns to the vessels in the skin tissue and the skin resumes its natural pattern, thus eliminating the impression.

As the human body ages, however, it takes longer for the body to remove skin impressions. Normally, this presents no problem because a person embarrassed about an impression may simply wear clothing over the impression. But when the impression occurs on the face, covering it with clothing is not an option.

The problem of facial impressions is most acute in senior women and frequently arises as a result of sleeping on a pillow, pillowcase or other surface which is capable of creasing. The crease in the pillow or pillowcase surface is transferred into a wrinkle in the human face. For most people, a shower is sufficient to remove the wrinkle from the face, but this is not so among the middle-aged. In some instances, the wrinkle may survive the shower and present a facial wrinkle that the bearer is embarrassed to have.

As a result, several prior art devices have been developed to allow a middle-aged person to sleep comfortably in a manner which does not subject the face to creases. One such prior art device is disclosed in U.S. Pat. No. 3,312,987 for a Small Wrinkle Free Face Pillow, issued to William M. Emery on August 11, 1967. The patent to Emery discloses a small inflatable pillow having an inflatable bladder covered by a sheet of foam to provide a feeling of softness over the exterior of the pillow. The device of the Emery patent, however, suffers from several drawbacks. First, the Emery pillowcase cannot be used without the Emery pillow. Second, since the pillow supports only the head, jaw and cheek of a user, the number of positions that a user may sleep in is limited. Third, a person requiring a soft down-filled or fibre-filled pillow cannot use the device of Emery because it is too structured and too firm.

Other prior art pillow devices include a normal bed pillow having a central depression for accommodating the back of a human head. The design strategy is to accommodate the back of the head so that the face does not come in contact with a surface or, to the extent it does, the surface is merely tangential to the face and, therefore, very little pressure is applied to the face, minimizing the likelihood of a wrinkle.

All these prior art devices, however, suffer from deficiencies. For example, they all possess a solid pillow structure which essentially holds the head in a fixed or relatively fixed position. A disadvantage presented by such a structure is that it denies a person the opportunity to sleep in different positions. A second disadvantage is that if a person is traveling and desires to maintain a wrinkle free appearance, the person must necessarily lug around the bulky fixed position pillow.

Having discussed prior art "pillows" which are designed to provide wrinkle free sleep, attention is now drawn to "pillowcase" prior art. Although the prior art does not teach a wrinkle free pillowcase, the prior art includes pillowcases that have been developed to protect hairdos overnight without caps, nets, clips, or wraps. Satin has been used as the material in this type of pillowcase. Although satin may be a smooth material which protects hairdos, it is still capable of creasing and, therefore, producing wrinkles in the face of one who sleeps on it.

Accordingly, it is an object of the present invention to provide a wrinkle free pillowcase which when used with a specific sized bed pillow creates a wrinkle free surface.

It is another object of the present invention to provide a wrinkle free pillowcase which can be made of varying sizes to accommodate standard, queen and king size pillows common in the bedding industry, regardless of fiber content, be it down feathers, polyester fiber fill, foam rubber or a variation thereof, as long as the size of the pillow meets the industry specifications.

It is still another object of the present invention to provide a wrinkle free pillowcase of a nylon spandex material which is stretched tautly across the surface of a pillow in such a manner as to create a smooth wrinkle free surface on the exterior of that pillow.

It is yet a further object of the present invention to provide a velcro, zipper or other closure to securely hold the pillowcase of the present invention about a pillow.

The attainment of the foregoing and related objects, advantages and features of the invention should be more readily apparent to those skilled in the art, after review of the following best mode of carrying out the present invention, taken together with the drawings.

DISCLOSURE OF THE INVENTION

A wrinkle free pillowcase in accordance with the present invention is for use with a bed pillow and includes at least a first and second section of fabric joined along three sides, each section of fabric having a length and width measurements less than that of the pillow. Releasable fasteners are provided along a fourth side of the pillowcase so that the pillowcase is fastenable about the pillow. The fabric is smooth and radially elastic so that when the pillow is placed within the pillowcase and the fasteners fastened, the compressive strength of the pillow causes the radially elastic fabric to stretch across the surface of the pillow creating a surface tension in said fabric which removes creases from the fabric, thereby creating a crease free pillowcase surface.

BRIEF DESCRIPTION OF THE DRAWINGS

FIG. 1(*b*) is a perspective view of a standard size bed pillow.

FIG. 1(*c*) is a perspective view of the pillowcase of FIG. 1(*a*) on the pillow of FIG. 1(*b*).

BEST MODE OF CARRYING OUT THE INVENTION

In the bedding industry, there are primarily three pillow sizes. These are the standard size, queen size and king size. Although standard, queen and king size pillows may contain different fill material, ranging from polyfill to down, the overall dimensions of the pillow, particularly the width and length are substantially the same for all pillows within the respective sizes of standard, queen and king. The width and length measurements of a standard size are 20 inches by 26 inches. For a queen size pillow, they are 20 inches by 30 inches and for a king size pillow they are 20 inches by 36 inches.

The discussion that follows will focus mainly on the standard sized pillow in an effort to illustrate the precepts of the invention. It will be understood, however, that the teaching of the present invention with respect to a standard size pillow is readily extendable to a queen and king size pillow. The physical dimensions of the pillowcase for use with a queen or king size pillow are simply extrapolatable from the dimensions of the standard size pillowcase and standard size pillow.

Figures 1A, 1B, 1C:
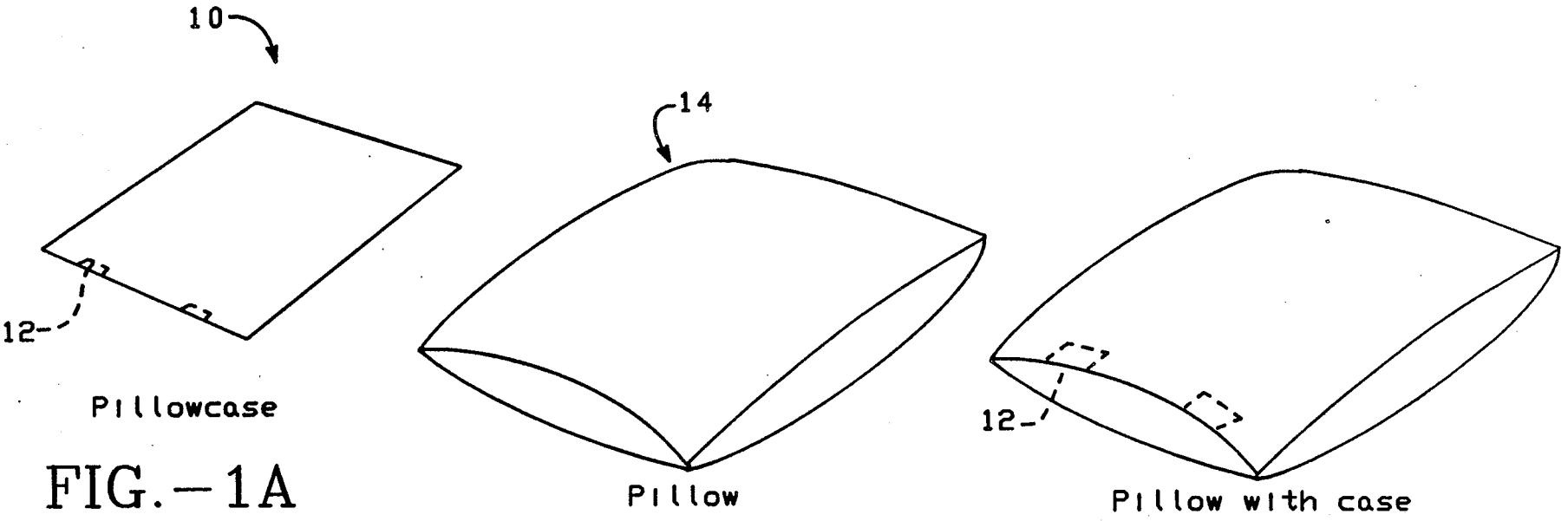
FIG. 1(*a*) is a perspective view of the pillowcase of the preferred embodiment for a standard size pillow.

Referring to FIGS. 1(a)–1(c), a pillowcase 10 of the preferred embodiment for a standard size pillow 14 is shown. The primary purpose of FIG. 1 is to illustrate the physical characteristics of the pillowcase alone and as used on a standard sized pillow 14. Referring to FIG. 1(a) it is apparent that the pillowcase 10 has a smaller width and length than the pillow 14 on which it is used. Thus, as will be described in more detail below, the pillowcase 10 is made of an elastic material that is radially elastic about 360°. The pillowcase 10 is stretched over the pillow 14 and sealed at its open end. The stretched pillowcase material creates a surface tension across the surface of the pillow 14. This smooth surface tension (illustrated in FIG. 1(c)) creates an essentially crease free surface. The specific dimensions of the pillowcase 10 and the pillow 14 will now be described in more detail.

The pillowcase 10 has a length of approximately 22 to 23 inches. Approximately 1 inch of this length accommodates a velcro strips 12 which secures the pillowcase 10 about pillow 14. The width of the pillow 10 is approximately 15 inches. By contrast, a standard pillow has a length of 26 inches and a width of 20 inches. Given these dimensions it is necessary to stuff the pillow 14 of FIG. 1(b) into the pillowcase 10 of FIG. 1(a) to form the embodiment of FIG. 1(c).

The pillowcase 10 stretches to accommodate the size of the larger pillow 14. The pillowcase 10 is stretched over the surface of the pillow 14 and the opening is sealed by velcro closures 12. The elastic material of the pillowcase 10 basically accommodates to the shape of the pillow 14 because from a relative strength standpoint the pillow is much firmer than the elastic material of the pillowcase 10. As a result, the pillow 14 is only constricted marginally, the new width being approximately 19½ inches and the new length approximately 25 inches. Note that the amount of pillow constriction will vary based on fill material, etc.

In order to accommodate the larger sized pillow 14, the pillowcase 10 must be made of an elastic material. In the preferred embodiment, this material is 85% nylon and The invention, however, is not limited to these specific percentages. Rather, the general requirement of the material is that it be smooth yet elastic along all axes in the plane of the material. Other fiber content combinations that are workable include 80% nylon-20% spandex, 60% nylon-40% spandex, 75% nylon-25% spandex and 50% nylon-50% spandex. It should be appreciated, however, that a pillowcase 10 made of these combinations would have to be adjusted dimensionally to compensate for the change in relative elasticity. Note also that a 95% nylon-5% spandex material is commercially available, but this material yields poor results because it does not have enough elasticity.

Figure 2C:
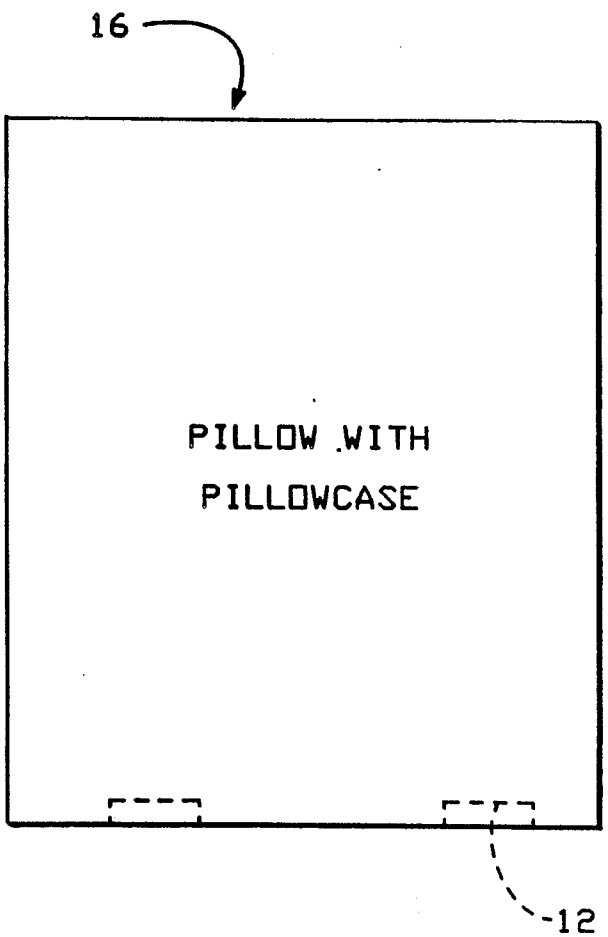
FIGS. 2(*a*)–(*c*) illustrate top views of the pillowcase of the preferred embodiment for a standard pillow, a standard pillow and a standard pillow having the pillowcase thereon, respectively.
Figure 2B:
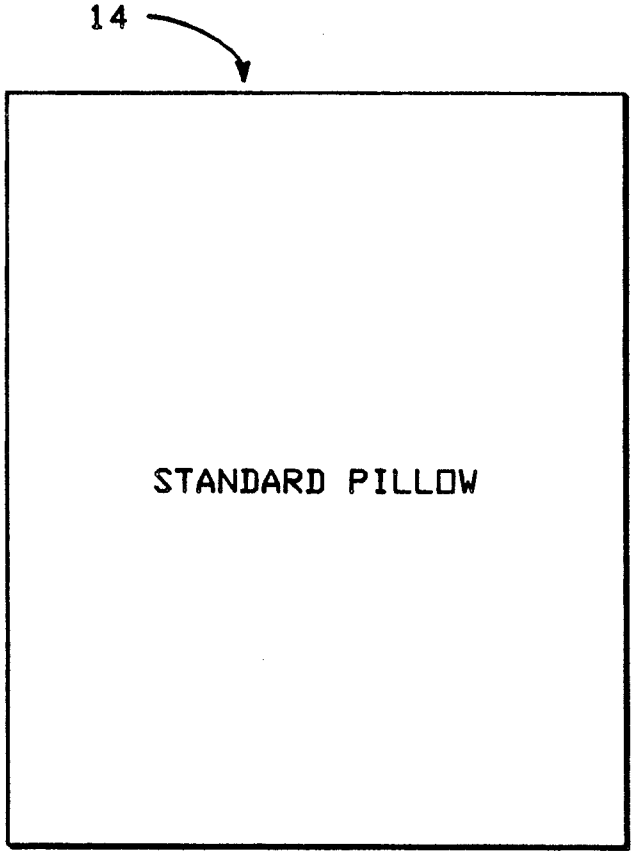
Figure 2A:
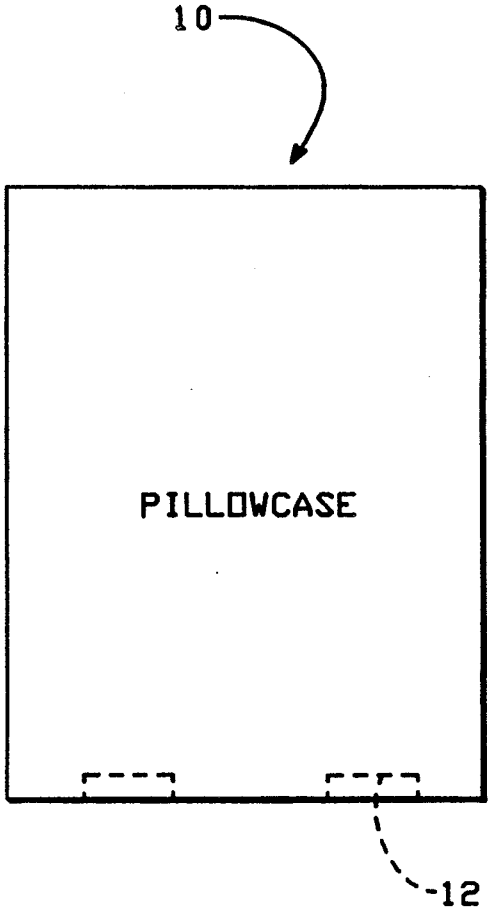

Referring to FIGS. 2(a)–(c), the dimensional aspects of the pillowcase 10, standard pillow 14 and combined pillow and pillowcase 16, are illustrated from a top perspective. It is apparent that the pillowcase 10 is 15 inches in width and approximately 22 inches in length, excluding the portion which accommodates the closure mechanism (in this case, VELCRO brand hooks and loops fastener strips 12). The pillowcase 10 fits about the larger standard pillow 14. It is apparent from FIG. 2(c) that the combined pillow and pillowcase 16 is only slightly smaller than the standard pillow 14 alone.

Figure 3A:
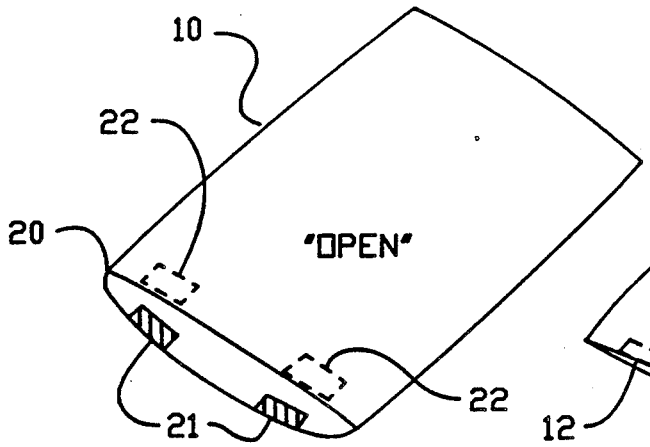
FIGS. 3(*a*)–(*b*) illustrate velcro closures on the pillow case of the preferred embodiment.
FIGS. 3(c)–(d) illustrate zipper closures on the pillowcase of the preferred embodiment.
Figure 3B:
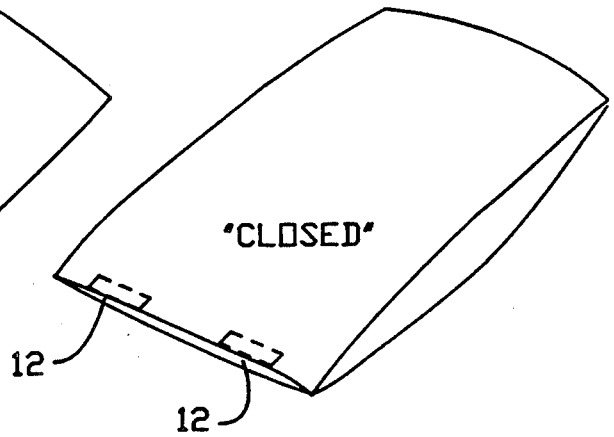

Referring to FIGS. 3(a)–(d), closure mechanisms of the wrinkle free pillowcase 10 will now be described. Referring to FIG. 3(a), the VELCRO closure mechanisms (12 of FIGS. 1 and 2) are shown in greater detail. On one side of the pillowcase opening 20 are stitched two male (hooks) VECLRO strips 21. Opposite these strips 21 are two female (loops) VELCRO strips 22. Once the pillow 14 is inserted inside the pillowcase 10 and the pillowcase 10 pulled taut across the surface of the pillow 14, the male and female VELCRO strips 22–21 are pushed together to seal the pillowcase 10 about a pillow 14. The closed pillowcase structure is illustrated in FIG. 3(b). The position of the VELCRO strips in the sealed pillowcase arrangement is indicated by the reference numeral 12. In the preferred embodiment, the pillowcase 10 must necessarily have closures 12 to ensure that the pillowcase material is pulled taut across the surface of the pillow 14, thereby eliminating creases in the pillowcase 10.

Figure 3C:
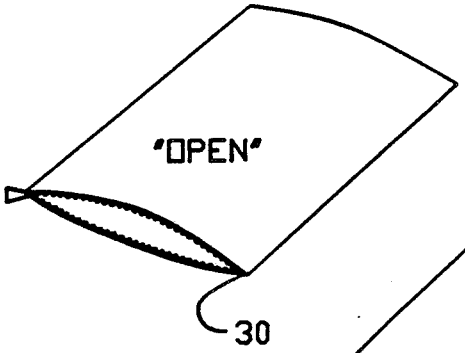
Figure 3D:
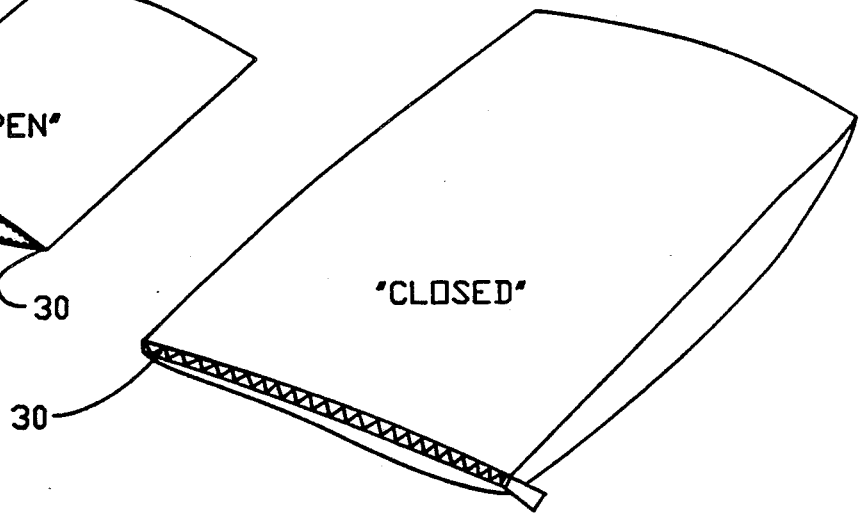

Referring to FIGS. 3(c)–(d), a zipper 30 is shown, alternatively, as a closure mechanism. In FIG. 3(c), the zipper 30 is shown in the open position. In FIG. 3(d), the zipper 30 is shown in the closed position. A standard zipper 30 for use in this embodiment is well known in the art. Other fastening means to secure the pillowcase 10 about the pillow 14 are well known in the art and considered to be obvious extentions of the present invention. These fastening means include buttons and zip-lock seals, etc.

Figure 4:
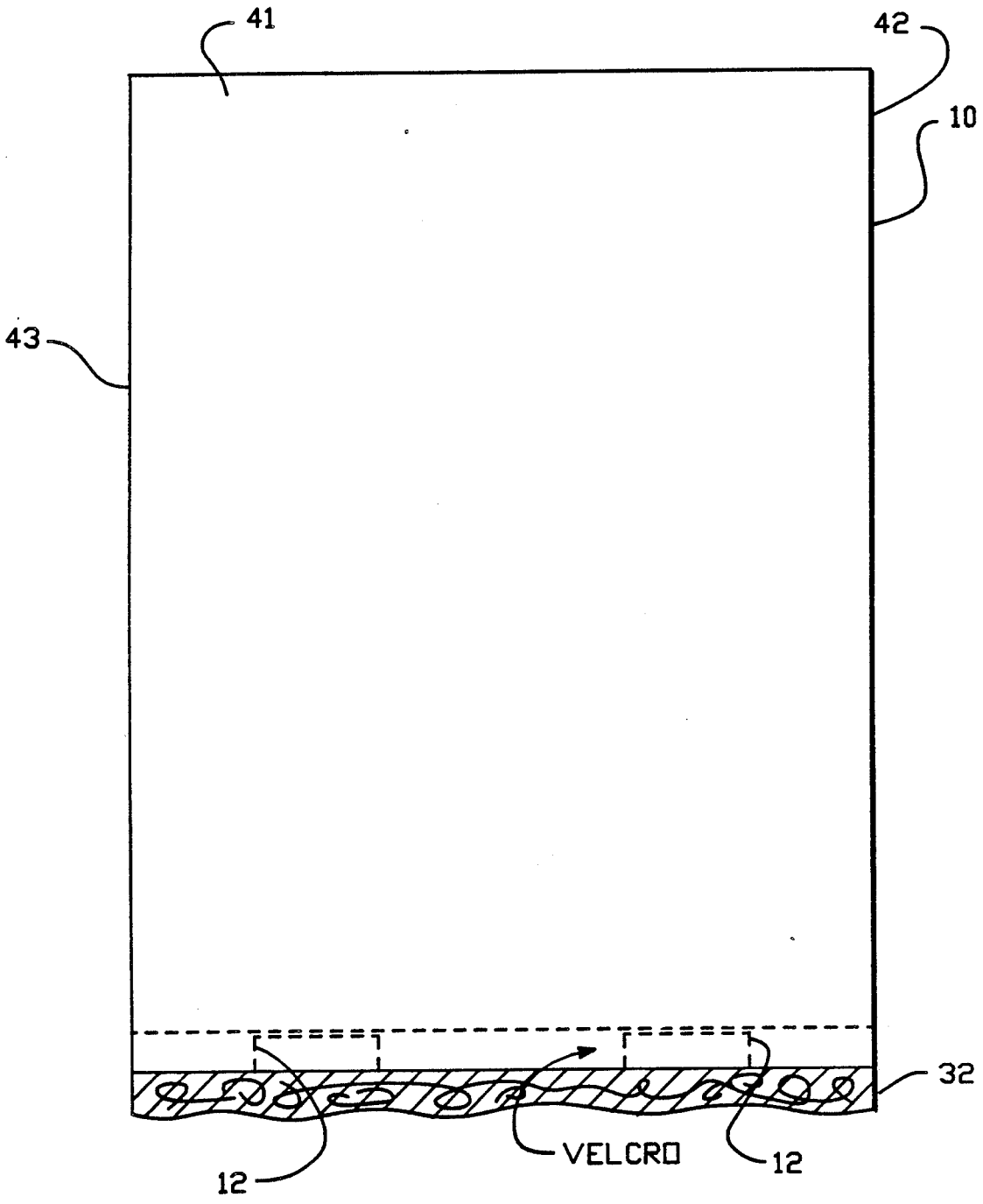
FIG. 4 illustrates the construction and specifications of the pillowcase of the preferred embodiment including the addition of lace.

Referring to FIG. 4, a top view of the pillowcase 10 of the preferred embodiment is shown. The main purpose of FIG. 4 is to show the construction and seam specifications of the pillowcase 10. In the preferred embodiment, overlock seam construction is utilized on a side 41 opposite the fasteners 12 and on a side 42 opposite a folded side 43 to essentially form the pillowcase 10. Overlock seam construction is used along the inside of sides 41 and 42. Overlock seam construction is well known in the art.

Another purpose of FIG. 4 is to show that the pillowcase 10 may have lace 32 or other ornamental aesthetic features attached thereon to enhance attractiveness.

Having described the physical structure of the pillowcase 10, the benefits provided by this structure will now be discussed. In essence, the present invention provides a lightweight, durable and portable method of ensuring a wrinkle free night's sleep. Since the present invention may be made to accommodate any bedding industry size bed pillow, including the standard, queen and king size pillows, the pillowcase 10 may be taken on business trips or vacations and easily be substituted for the pillowcase provided on a hotel or motel pillow. Since the pillowcase sizes are normalized in the industry, a person desiring a wrinkle free night's sleep can simply take the existing pillowcase off of the pillow and substitute the pillowcase 10. The motel or hotel pillow is then provided with a smooth, taut, wrinkle free surface.

Another important benefit of the present invention is that it enables the user to sleep in any position, i.e., on their side or back, etc. It is not limited to a small number of fixed positions or fixed placements with respect to one's head and/or face as are prior art pillows and pillowcases.

The foregoing description of specific embodiments of the present invention has been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. In a pillowcase formed for mounting over a resiliently compressible pillow of known shape and known length and width dimensions, said pillowcase being formed as a hollow fabric shell having two opposed sheet portions substantially conforming to said known shape of said pillow and having an opening therein for mounting of said pillowcase over said pillow, the improvement in said pillowcase comprising:

said fabric shell being formed with length and width dimensions which both are smaller than said known length and width dimensions of said pillow, and said fabric shell being formed of a material having sufficient elasticity to be stretched in both length and width dimensions over said pillow and resiliently distend into a substantially crease-free condition covering said pillow; and closure means mounted to said pillowcase proximate said opening and formed to releasably secure said pillowcase in said crease-free condition over said pillow.

2. The pillowcase as defined in claim 1 wherein, said fabric shell is formed of a woven fabric having nylon fibers and spandex fibers.

3. The pillowcase as defined in claim 2 wherein, said fabric shell is comprised of 85% nylon fibers and 15% spandex fibers.

4. The pillowcase as defined in claim 2 wherein, said fabric shell is comprised of about 10% to about 50% spandex fibers.

5. The pillowcase as defined in claim 1 wherein, said closure means is a hooks and loops fastener assembly with a hooks portion mounted to said pillowcase proximate one side of said opening and a loops portion mounted to said pillowcase proximate an opposite side of said opening.

6. The pillowcase as defined in claim 1 wherein, said closure means is a zipper.

7. A pillowcase for use with a bed pillow having a known surface area in a relaxed condition, comprising:

pillowcase means having a surface area in an unstretched condition less than said known surface area of said pillow in said relaxed condition, said pillowcase means having at least one opening therein for insertion and removal of said pillow;

releasable fastening means mounted to said pillowcase proximate said opening for releasably fastening said opening in a closed condition to secure said pillowcase about said pillow; and said pillowcase means being made of a smooth material which is elastically stretchable in both length and width dimensions and formed of a woven nylon fiber and spandex fiber fabric having sufficient elasticity when said pillow is positioned inside said pillowcase and said fastening means is fastened, to resiliently expand the surface area of said pillowcase in both length and width dimensions by said pillow until said elastic material is stretched across the surface of said pillow into a smooth crease-free surface over said pillow.

8. The pillowcase as defined in claim 7 wherein, said material is comprised of 85% nylon fibers and 15% spandex fibers.

9. The pillowcase as defined in claim 7 wherein, said material is comprised of at least 10% spandex fibers.

10. A method of fabricating a wrinkle-free pillowcase for a bed pillow, comprising the steps of:

forming smooth, radially elastic woven fabric material formed from nylon fibers and spandex fibers into a pillowcase having at least two opposed sheet portions and an opening therebetween to receive a pillow, said forming step being accomplished by forming said pillowcase to have length and width measurements when said pillowcase is in a relaxed condition less than same measurements for said pillow; and mounting releasable closure means to said pillowcase proximate said opening to enable securing said pillowcase about said pillow so that when said pillow is inserted in said pillowcase and said opening closed, said smooth elastic material is elastically stretched in both length and width measurements across the surface of said pillow to create a smooth, crease-free surface in said pillowcase.

11. A wrinkle free pillowcase for use with a pillow having a known shape and a known volume, said pillowcase comprising:

a hollow body having two opposed sheet portions a shape substantially conforming to said known shape of said pillow and having an opening therein to an interior of said hollow body permitting mounting of said hollow body on said pillow;

said hollow body being formed from a smooth, elastic fabric of woven nylon and spandex fibers, said fabric being resiliently stretchable along two mutually perpendicular axes, and said hollow body being dimensioned to define an interior volume, when said elastic fabric is in a relaxed condition, which is sufficiently smaller than said known volume of said pillow to require stretching of said elastic fabric in two mutually perpendicular directions to a distended, substantially wrinkle-free condition, when said hollow body is mounted on said pillow; and securement means carried by said hollow body for releasably securing said opening in said hollow body to retain said elastic fabric in said wrinkle-free condition when mounted on said pillow.

* * * * *

UNITED STATES PATENT AND TRADEMARK OFFICE

CERTIFICATE OF CORRECTION

PATENT NO. : 5,084,928

DATED : February 4, 1992

INVENTOR(S) : Adrienne M. Skillington

It is certified that error appears in the above-identified patent and that said Letters Patent is hereby corrected as shown below:

Col. 4, line 2, after "and" insert ---15% spandex.---.

Signed and Sealed this

Twenty-fifth Day of May, 1993

*Attest:*

Michael K. Kirk

MICHAEL K. KIRK

*Attesting Officer*

*Acting Commissioner of Patents and Trademarks*